US005390714A

United States Patent [19]

North, III et al.

[11] Patent Number: 5,390,714

[45] Date of Patent: Feb. 21, 1995

[54] CUP LOCATOR FOR BEVERAGE DISPENSER

[75] Inventors: Thomas G. North, III, Marietta, Ga.; Jose I. Smith, Miami, Fla.; Samuel Durham; M. Zane Farmer, both of San Antonio, Tex.

[73] Assignee: The Coca-Cola Company, Atlanta, Ga.

[21] Appl. No.: 56,284

[22] Filed: Apr. 30, 1993

Related U.S. Application Data

[63] Continuation-in-part of Ser. No. 883,512, May 15, 1992, abandoned.

[51] Int. Cl.[6] ..... B65B 1/04

[52] U.S. Cl. ..... 141/369; 141/88; 141/165

[58] Field of Search ..... 141/88, 165, 174, 369, 141/370, 312, 378, 106, 363, 364, 365, 367, 375, 94; 269/265, 268, 679, 303

[56] References Cited

U.S. PATENT DOCUMENTS

| | | | |
|---|---|---|---|
| 3,913,792 | 10/1975 | Brill et al. | 141/369 |
| 4,658,872 | 4/1987 | Ellis | 141/311 R |
| 4,832,075 | 5/1989 | Bonnell | 141/106 |
| 5,105,860 | 4/1992 | Connor | 141/369 |

FOREIGN PATENT DOCUMENTS

| | | | |
|---|---|---|---|
| 681331 | 8/1939 | Germany | 141/378 |

*Primary Examiner*—Henry J. Recla
*Assistant Examiner*—David J. Walczak
*Attorney, Agent, or Firm*—Lynne R. O'Brien

[57] ABSTRACT

The cup locator includes a plurality of non-concentric rings placed one on one top of the other from smallest to largest. A backstop is integrally formed at the rear of the cup locator. Different sized beverage cups will be properly positioned with respect to the nozzle of the beverage dispenser and the cup lips will be properly positioned within an acceptable range of positions with respect to an ultrasonic transducer.

13 Claims, 6 Drawing Sheets

CUP LOCATOR FOR BEVERAGE DISPENSER

CROSS-REFERENCE TO RELATED APPLICATION

This application is a continuation-in-part of U.S. application Ser. No. 07/883,512, filed on May 15, 1992, now abandoned.

BACKGROUND OF THE INVENTION

1. Field of the Invention

This invention relates to beverage dispensers and more particularly to a cup locator for properly positioning a variety of different sizes of cups under and relative to the transducer of an ultrasonic automatic cup filling system of a beverage dispenser.

2. Description of the Prior Art

It is known to provide a cup locator for properly positioning a variety of different sizes of cups on a cup rest below a beverage dispenser valve assembly, as shown, for example, in U.S. Pat. No. 3,913,792. However, when different sizes of cups are pushed into abutting contact with the prior art "V" shaped cup locator, the bottom edges and thus the lips of the cups may be in different locations, over an unacceptably large range, in the front to back direction, with respect to the nozzle. This creates a problem with respect to certain types of beverage dispensing valve assemblies, for example, those that use an automatic cup filling device of the type using ultrasonic energy transmitted down from an ultrasonic transducer and using ultrasonic energy reflected back up from a cup lip and from the inside of the cup to the transducer located adjacent the nozzle, and those that use portion controls.

U.S. Pat. No. 4,658,872 further attempts to solve this problem by providing a cup locator which includes a straight rear wall and a pair of spaced-apart, straight angled side walls, one at each end of the rear wall and each at an obtuse angle to the rear wall. However, this cup locator does not limit the placement of a cup by the operator. Accordingly, if the cups are not pushed completely back against the straight wall, the bottom-edges and thus the lips of the cups may be in different locations, over an unacceptably large range in the front to back direction, with respect to the nozzle.

It is an object of the present invention to provide a cup locator that is not subject to the disadvantages of the prior art cup locators.

It is another object of the present invention to provide a cup locator that can properly position a large variety of different sizes of cups below a valve assembly of a beverage dispenser.

It is a further object of this invention to provide a cup locator that will position the rear edge of the bottoms of cups of different sizes at the same identical position with respect to the nozzle of a beverage dispenser valve assembly, and which will also position the lips within an acceptable range of positions with respect to the transducer.

It is another object of the present invention to limit the placement of the cup by the operator.

SUMMARY OF THE INVENTION

A cup locator for use preferably in combination with a dispensing valve and nozzle, an ultrasonic transducer and including a cup locator means for properly locating in an upright position with respect to the nozzle and the transducer, each one of a plurality of different sized cups, each having different sized cup bottoms, in only one single possible location. In the preferred embodiment, the cup locator means comprises a plurality of non-concentric rings where the base of the cup locator is comprised of the smallest ring and a plurality of intermediatly sized rings are positioned on top of the smallest ring with the largest ring being positioned on top of the largest intermediate-sized ring. The smallest ring is provided with a central opening to allow ice and liquid to pass through the cup rest.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

Figure 1:
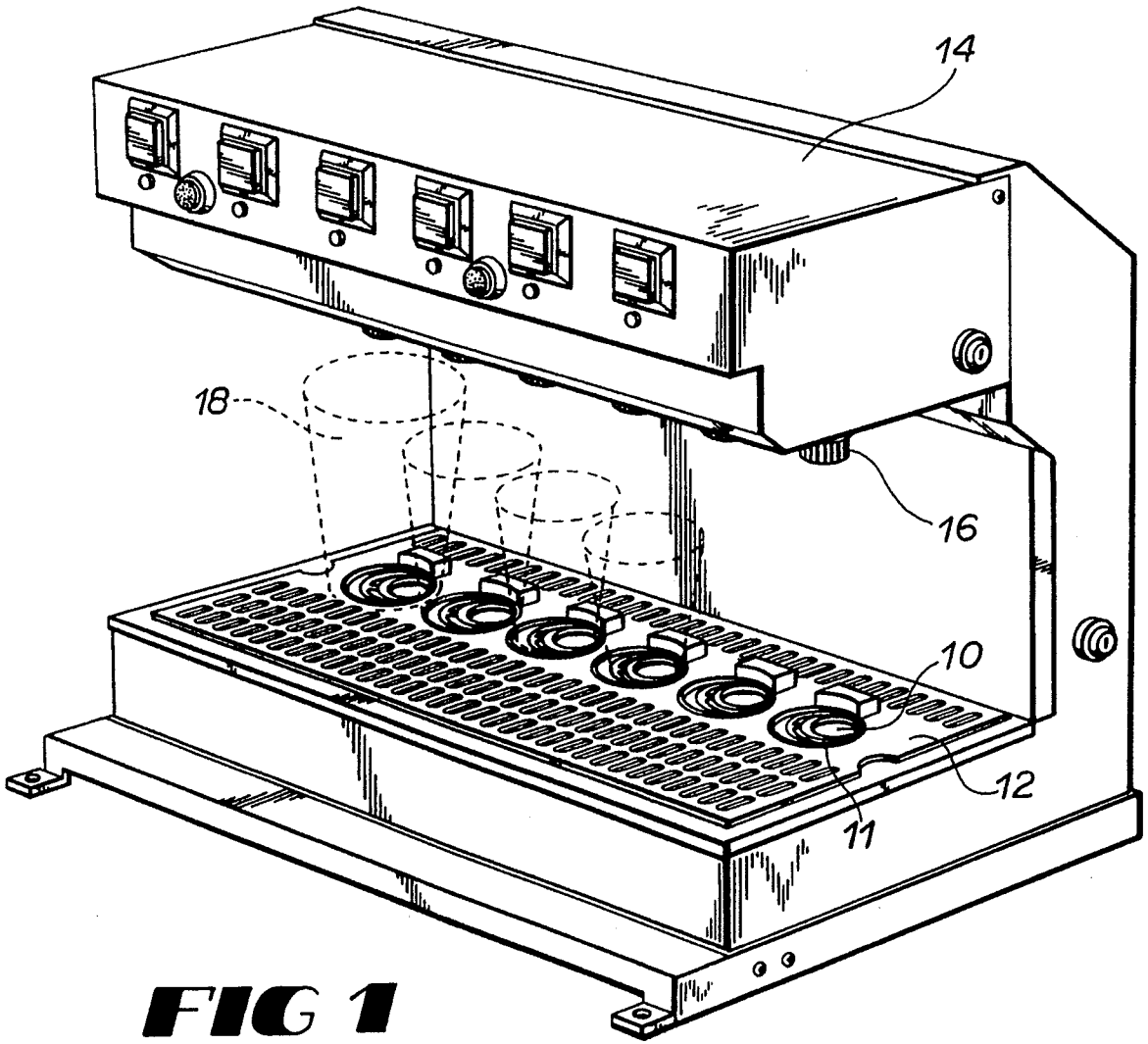
FIG. 1 is a perspective view of a beverage dispenser having six valve assemblies thereon and having a cup locator of the present invention under each valve assembly.
Figure 2:
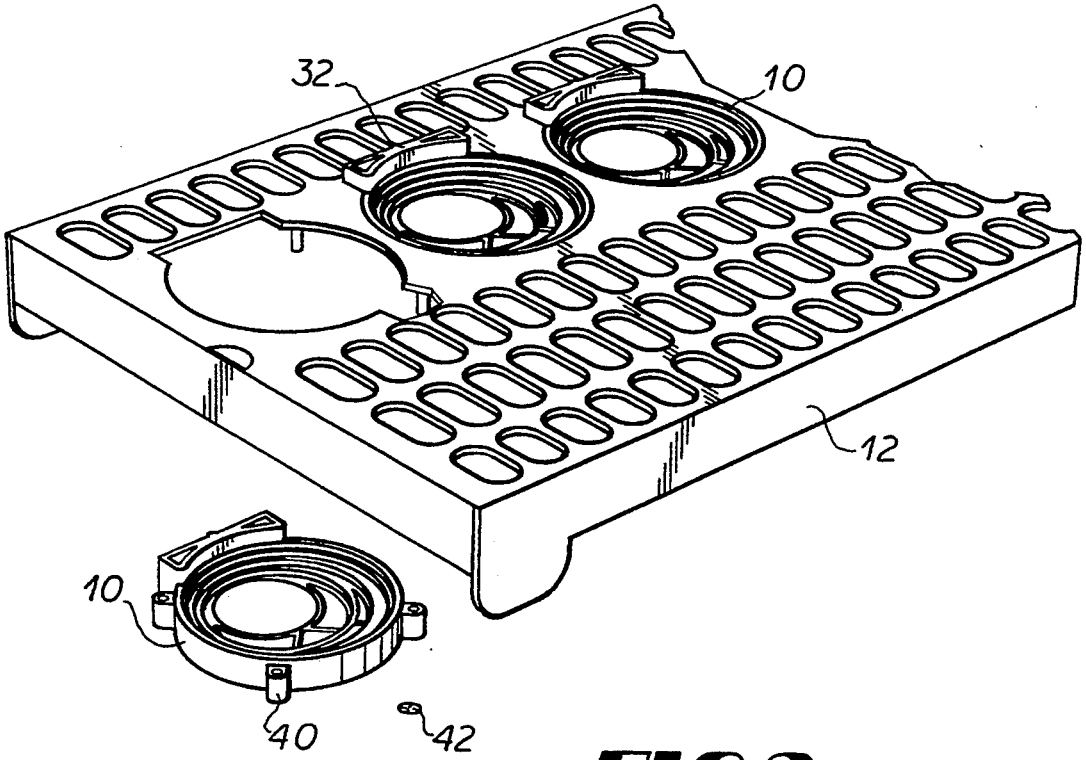
FIG. 2 is a perspective exploded view of the cup locator of the present invention.
Figure 3:
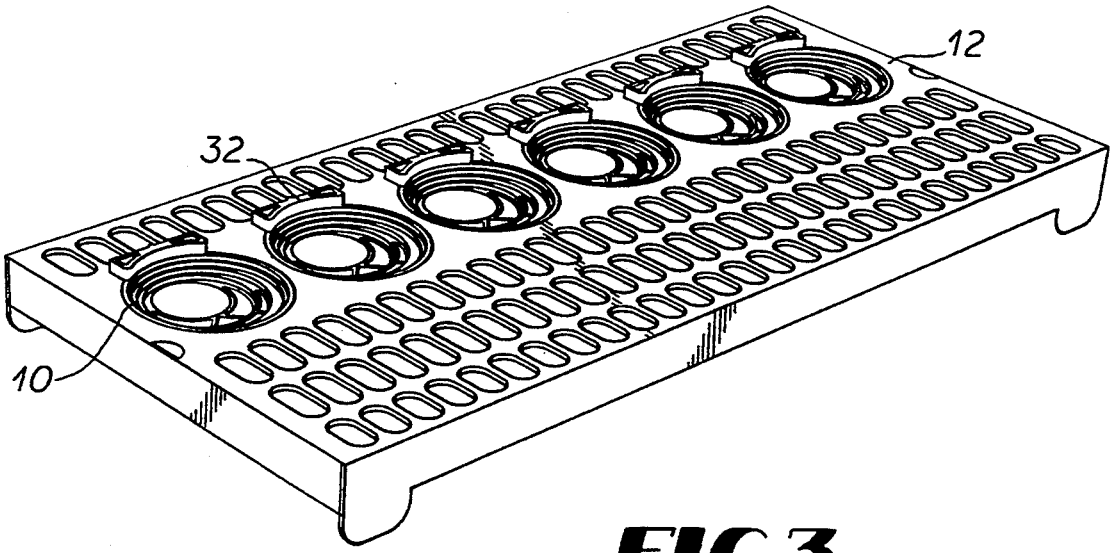
FIG. 3 is a perspective view of the cup locator of FIG. 2 connected to a cup rest.
Figure 4:
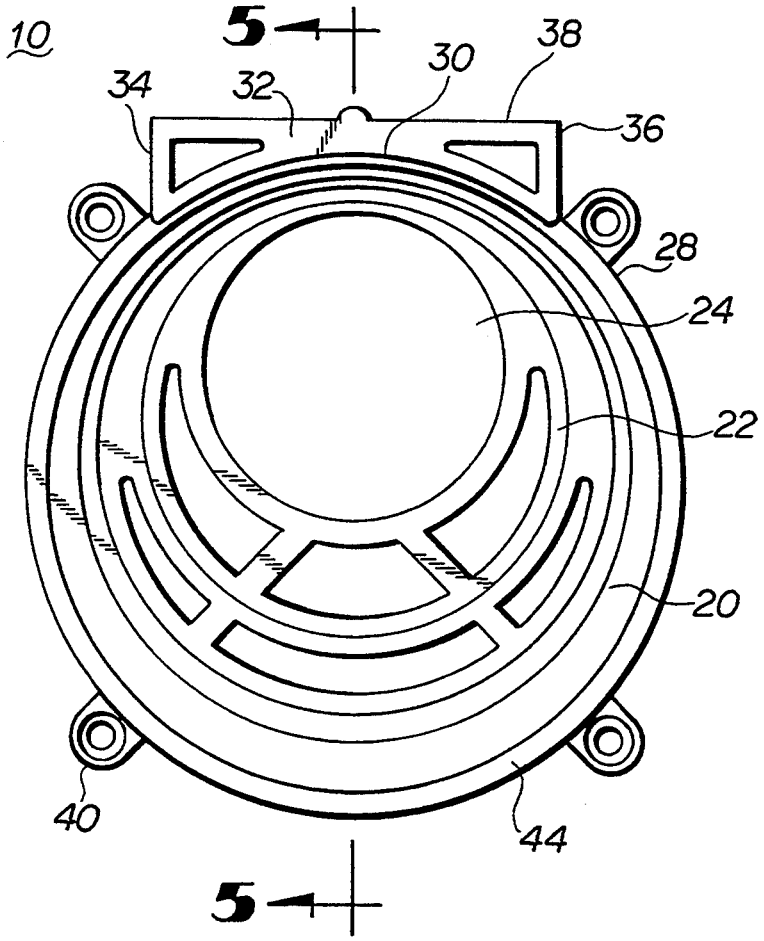
FIG. 4 is a top plan view of the cup locator of FIG. 2.

With reference now to the drawings, FIG. 1 shows six cup locators 10 having cup locator means 11 according to the present invention attached to a cup rest 12 of a beverage dispenser 14. The beverage dispenser 14 has six valve assemblies (not shown) and a cup locator 10 is positioned below each valve assembly and is affixed to the cup rest 12 in the proper position relative to the nozzles 16 of the valve assemblies to ensure that, regardless of what size cup 18 (within a given range of cup sizes) is placed below a particular nozzle of the cup locator, all of the beverage to be dispensed will flow into the cup 18. The cup locator means 11 properly positions a plurality of different sized cups, each having different sized cup bottoms, in only one single possible location with respect to the nozzle 16 and a transducer 46. If the operator does not properly place the cup 18 in the cup locator means 11, the cup will be tilted or will fall over.

FIGS. 2–6 show the cup locator 10 in detail. The cup locator 10 comprises four non-concentric rings 20, with the smallest ring 22 comprising the bottom of said cup locator 10. Said smallest ring 22 includes a central opening 24 to allow ice and liquid to flow through the cup rest 12. A pair of ribs 26 extend outwardly from said opening 24 to provide strength and support to the cup locator 10. Rings 20 of increasingly larger size are located on top of the smallest ring 22 in order to accommodate a number of different sized cups and to prevent cups from tipping over. Each of said rings 20 is located in a different horizontal plane from said smallest ring 22. Extending upwardly from the rear wall 28 of the largest ring 44 is the curved front wall 30 of back stop 32. The back stop also includes two straight side walls 34, 36 and a straight rear wall 38. The cup locator 10 is provided with four arms 40 equally spread apart from each other around the perimeter of the cup locator 10 which allows the cup locator 10 to be attached to the cup rest 12 by rivets 42 such that the largest ring 44 is flush with the cup rest 12.

The height of the cup locator 10 is preferably about ¾ inch. The diameters of the rings from smallest to largest are preferably 2.180 inches, 2.535 inches, 2.860 inches and 3.015 inches. The diameter of the central opening 24 is preferably 1.5 inches.

Figure 5:
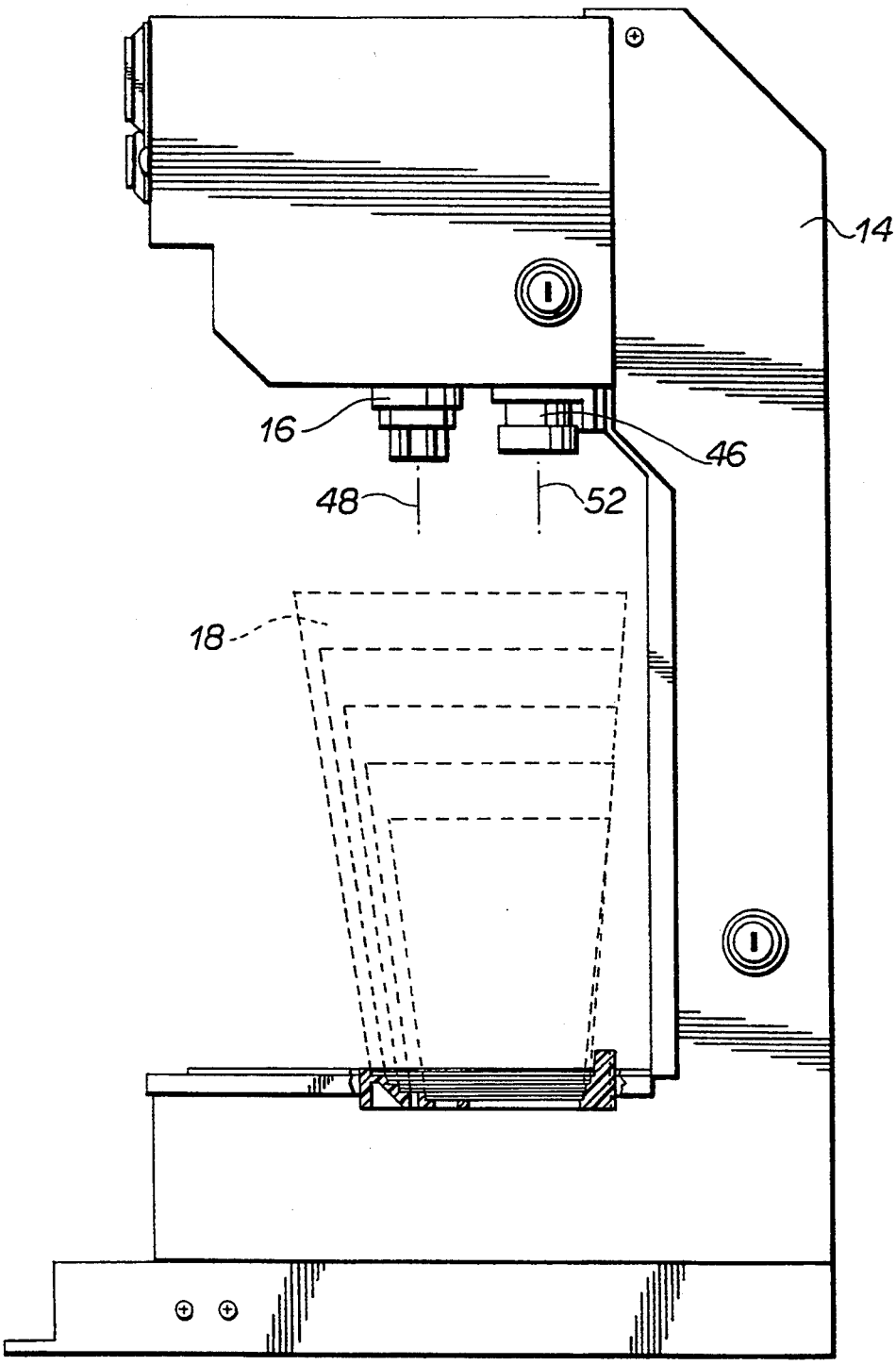
FIG. 5 is a cross-sectional view of the cup locator of FIG. 2 taken along line 5—5 of FIG. 4 in combination with a dispensing valve and nozzle and an ultrasonic transducer of an automatic filling device.
Figure 6:
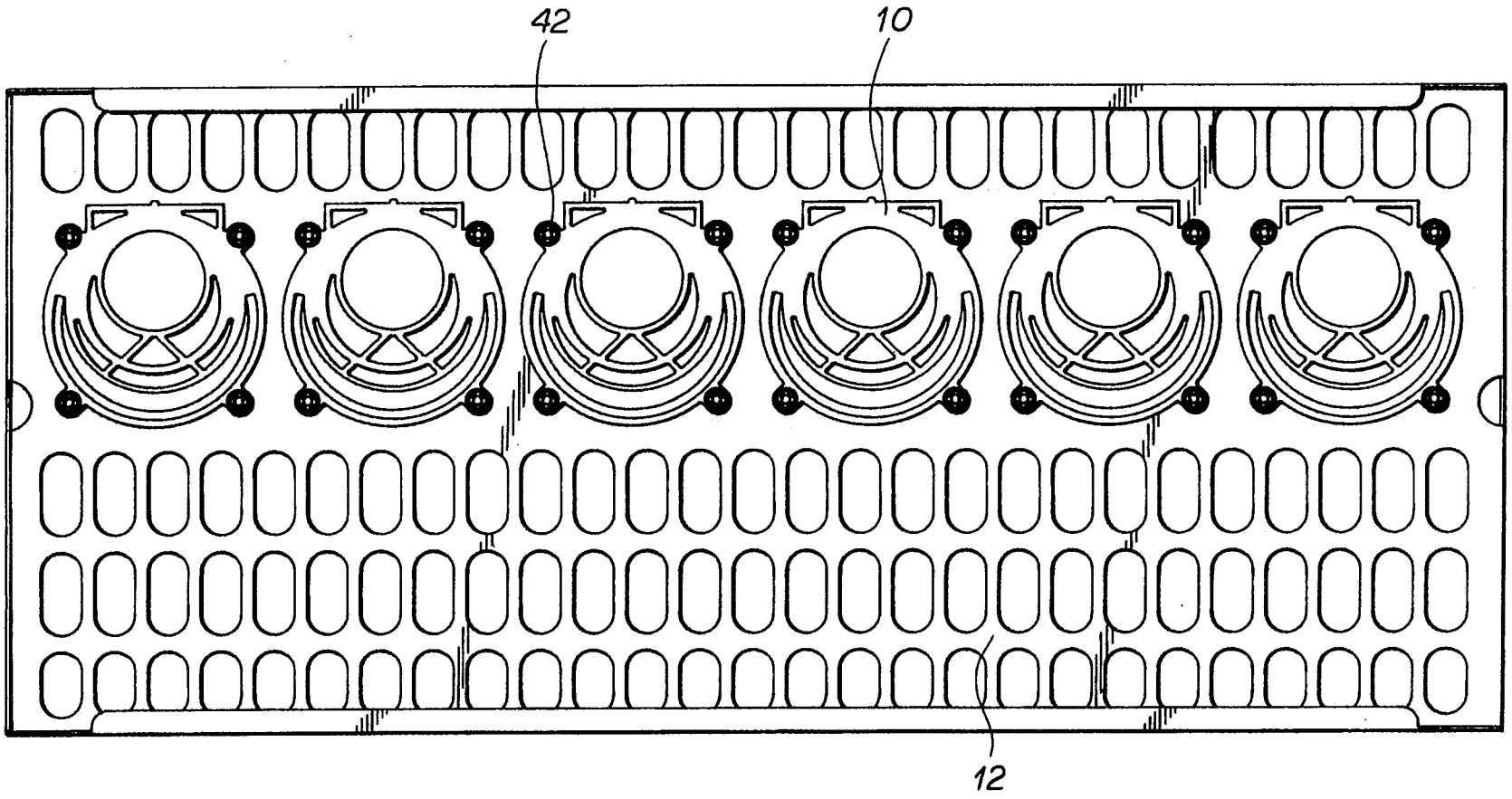
FIG. 6 is a bottom plan view of the cup locator of FIG. 2 connected to a cup rest.

The transducer 46 is preferably positioned as close as possible to the nozzle 16 and is preferably behind the nozzle 16 although it can alternatively be in front or to the side of the nozzle 16. The transducer 46 can be mounted on the dispensing valve (not shown) or on the dispenser 14. The lower surface of the transducer 46 is preferably positioned above the lowest surface of the nozzle 16. The nozzle 16 must be positioned with respect to the cups 18 so that the beverage will flow into the cups 18. As shown in FIG. 5, the centerline 48 of the nozzle 16 is somewhat forward of the centerline 50 of the cups. The centerline 52 of the transducer 46 as shown in FIG. 5 is somewhat forward of the rear lips of the cups and is positioned so that the transducer 46 can "see" both the lip and inside of each cup 18. The nozzle 16 is preferably about one inch above the lip of the tallest cup.

Figure 7:
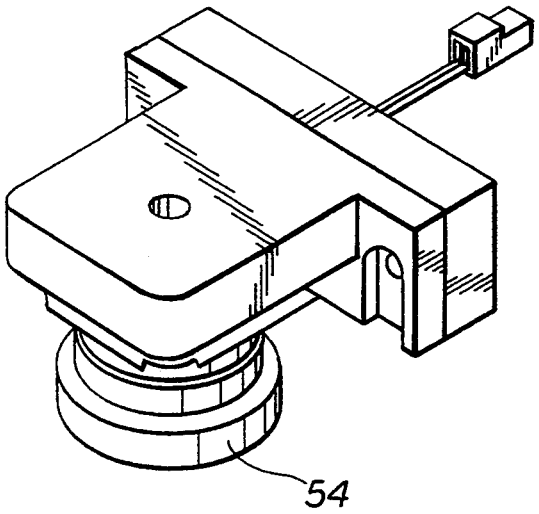
FIG. 7 is a perspective view of the transducer.
Figure 8:
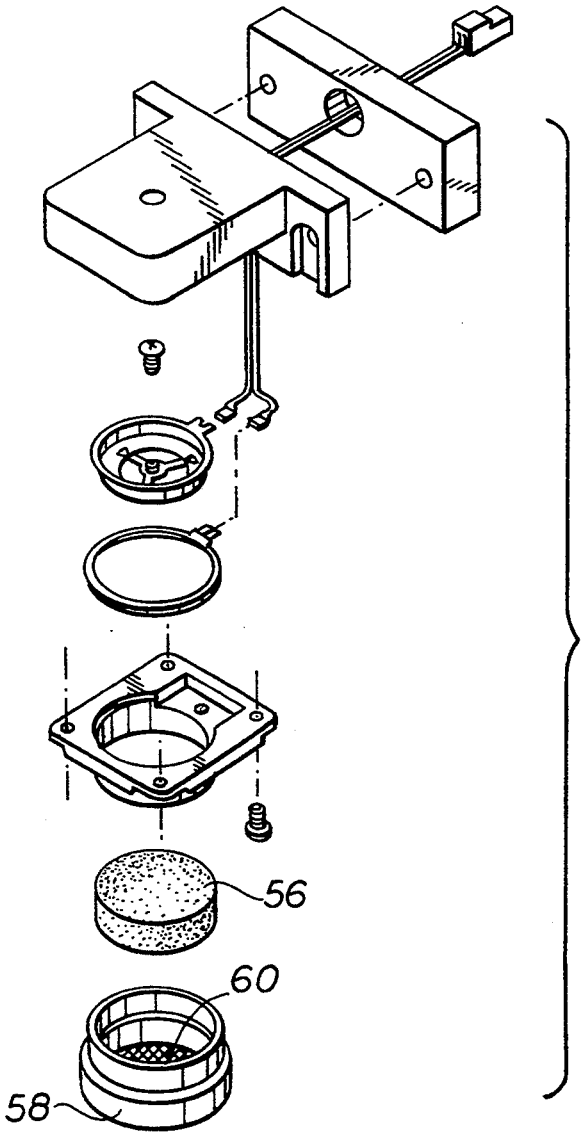
FIG. 8 is an exploded view of the transducer.

As shown in FIG. 7, the transducer 46 is provided with a cover 54, including a filter 56 and a cap 58, which includes a screen 60. The cover 54 prevents the transducer 46 from becoming wet.

The cup locator 10 is preferably made of 151 nylon.

While the preferred embodiment of this invention has been described above in detail, it is to be understood that variations and modifications can be made therein without departing from the spirit and scope of the present invention as set forth in the appended claims. For example, the cup locator can be an integral part of the cup rest. The number of cup locators can be varied according to the number of valve assemblies, and the actual number of cup locator means of the cup locator can be varied according to the number of different sized cups to be used. The cup locator and cup locator means need not be confined to rings. They can be comprised of squares, triangles or segments thereof. The cup locator is not limited to use solely with beverage dispensers; it may also be used with other types of dispensers, for example, ice dispensers.

What is claimed is:

1. A cup locator for a beverage dispenser comprising:

(a) a cup rest adapted to be mounted on said dispenser and having at least one aperture therethrough;

(b) a plurality of differently sized non-concentric rings, each sized to fit a different sized cup bottom and arranged one on top of the other from smallest to largest, said rings being mounted within said aperture of said cup rest for properly locating each of said cups in an upright position with respect to a transducer on said dispenser such that each one of a plurality of different sized cups can be in only one single possible location;

(c) a base mounted to said smallest ring and having a central opening to allow ice and liquid to flow through said cup rest;

(d) a pair of ribs extending outwardly from said base to support and strengthen said cup locator; and (e) a back stop extending upwardly from a rear perimeter of said largest ring.

2. The cup locator as recited in claim 1 wherein said number of said rings is four.

3. The cup locator as recited is claim 1 wherein the diameter of each of said rings from smallest to largest is 2.180 inches, 2.535 inches, 2.860 inches and 3.015 inches.

4. The cup locator as recited in claim 1 including a beverage dispenser having a valve assembly with a nozzle, said cup rest located below said nozzle, and said cup locator being positioned below said nozzle in said cup rest for positioning the rear edge of the bottom of a variety of different sized of cups, at the same identical front-to-back distance behind the center-line of said nozzle.

5. The cup locator as recited in claim 1 wherein each of said intermediate and largest rings are located in different horizontal planes from said smallest ring.

6. The cup locator as recited in claim 1 including means for connecting said cup locator to said cup rest of a beverage dispenser.

7. The cup locator as recited in claim 4 wherein said connecting means includes four arms equally spaced apart around the perimeter of said cup locator which are attached to said cup rest by rivets such that said largest ring is flush with the cup rest.

8. The cup locator as recited in claim 4 including an ultrasonic transducer positioned adjacent said nozzle and positioned with respect to each of said cups such that it can "see" both the lip and inside of each such cup.

9. The cup locator as recited in claim 8 wherein said transducer is provided with a cover comprising a filter and a cap, which includes a screen to prevent the transducer from becoming wet.

10. The cup locator as recited in claim 1 wherein the diameter of said central opening is 1.5 inches.

11. A cup locator for a beverage dispenser comprising:

(a) a dispenser having a beverage dispensing nozzle for dispensing beverage into a cup located therebelow;

(b) a cup rest on said dispenser spaced-apart from and below said nozzle for supporting a cup to receive beverage dispensed from said nozzle;

(c) a cup locator positioned on said cup rest below said nozzle for properly positioning any one of a number of differently sized cups with reference to said nozzle so that beverage dispensed from said nozzle will flow into such properly positioned cup; and (d) said cup locator comprising a plurality of separate, differently sized, cup holder means, each for holding only one size of cup in only one specific location, and each of said cup holder means being located below and out of the way of each larger cup holder means.

12. The cup locator as recited in claim 11 wherein each of said cup holder means includes a flat horizontal surface for supporting a cup bottom, and a vertical surface for contacting a cup sidewall.

13. The cup holder as recited in claim 12 wherein each of said vertical walls is circular and continuous in length.

* * * * *